US011746735B2

(12) United States Patent
Takada et al.

(10) Patent No.: US 11,746,735 B2
(45) Date of Patent: Sep. 5, 2023

(54) METHOD FOR CONTROLLING START OF ENGINE-DRIVEN GENERATOR

(71) Applicant: HONDA MOTOR CO., LTD., Tokyo (JP)

(72) Inventors: Sho Takada, Wako (JP); Kohei Takizawa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/968,176

(22) Filed: Oct. 18, 2022

(65) Prior Publication Data

US 2023/0184202 A1 Jun. 15, 2023

(30) Foreign Application Priority Data

Dec. 14, 2021 (JP) ..... 2021-202739

(51) Int. Cl.
*F02N 11/08* (2006.01)
*F02N 11/04* (2006.01)
*F02B 63/04* (2006.01)

(52) U.S. Cl.
CPC ..... *F02N 11/0862* (2013.01); *F02B 63/04* (2013.01); *F02N 11/04* (2013.01); *F02N 2200/022* (2013.01); *F02N 2200/063* (2013.01)

(58) Field of Classification Search
CPC ..... F02N 11/04; F02N 11/06; F02N 11/0862; F02N 2200/022; F02N 2200/06; F02N 2200/061; F02N 2200/062; F02N 2200/063; F02B 63/00; F02B 63/02; F02B 63/04; F02B 63/042; F02D 29/06; F02D 41/062; F02D 41/064
See application file for complete search history.

(56) References Cited

U.S. PATENT DOCUMENTS 9,086,044 B2 7/2015 Hashimoto et al.
2002/0078914 A1* 6/2002 Manabe ..... F02N 11/0862 123/179.3
2006/0208739 A1* 9/2006 Schiller ..... G01R 31/3647 324/426
2009/0020092 A1* 1/2009 Kishibata ..... F02N 11/101 123/179.5
2009/0063014 A1* 3/2009 Tokugawa ..... F02D 41/3082 701/103

(Continued)

FOREIGN PATENT DOCUMENTS

DE 102004025240 A1 * 12/2005 ..... F02N 11/106
JP 2007100565 A * 4/2007

(Continued)

*Primary Examiner* — John M Zaleskas
(74) *Attorney, Agent, or Firm* — WHDA, LLP

(57) ABSTRACT

An engine-driven generator may comprise an engine, a generator, a motor, a battery, a power supply circuit, and a processor. The processor may be configured to detect that the battery has a sufficient power supply capability that enables a piston of the engine to pass over a compression top dead center, at the start of the engine. The processor may permit ignition of the engine in a case where the processor has detected that the battery has the sufficient power supply capability. The processor may avoid the ignition of the engine in a case where the processor has not detected that the battery has the sufficient power supply capability.

6 Claims, 4 Drawing Sheets

(56) References Cited

U.S. PATENT DOCUMENTS

2009/0085352 A1* 4/2009 Saito ..... H02P 6/16 290/7
2012/0292902 A1* 11/2012 Yamamura ..... B60L 50/16 290/31
2012/0292920 A1* 11/2012 Yamamura ..... H02P 27/08 290/40 B
2013/0338867 A1* 12/2013 Sato ..... B60W 30/192 903/903
2014/0299089 A1* 10/2014 Koenen ..... H02J 7/0013 123/179.28
2014/0366830 A1* 12/2014 Kawano ..... H02P 7/29 123/179.3
2015/0197235 A1* 7/2015 Yu ..... B60W 10/08 903/903
2016/0011275 A1* 1/2016 Saito ..... F02N 11/0862 324/430
2016/0115933 A1* 4/2016 Koenen ..... H01M 10/02 290/38 R
2018/0149104 A1* 5/2018 Yamashita ..... F02N 11/0803
2018/0347534 A1* 12/2018 Lebreux ..... F02N 11/0814
2019/0153988 A1* 5/2019 Lebreux ..... F02N 11/04
2019/0153989 A1* 5/2019 Lebreux ..... F02N 11/06
2019/0153990 A1* 5/2019 Lebreux ..... F02N 3/02
2019/0390621 A1* 12/2019 Yamamura ..... F02N 11/0848
2020/0056559 A1* 2/2020 Lebreux ..... F02N 11/0866
2020/0080503 A1* 3/2020 Lebreux ..... F02P 5/045
2020/0080504 A1* 3/2020 Lebreux ..... F02N 11/06
2020/0080505 A1* 3/2020 Lebreux ..... F02B 33/04
2020/0347812 A1* 11/2020 Hashizume ..... F02N 11/0862
2021/0003107 A1* 1/2021 Byun ..... B60K 6/48
2021/0062774 A1* 3/2021 Lebreux ..... F02N 11/0803
2021/0388804 A1* 12/2021 Kleczewski ..... B60R 16/02
2022/0364520 A1* 11/2022 Lebreux ..... F02B 33/04

FOREIGN PATENT DOCUMENTS

JP 2009248860 A * 10/2009
JP 2012-241562 A 12/2012
JP 2018204571 A * 12/2018 ..... F02N 11/106
KR 20180028158 A * 3/2018

* cited by examiner

METHOD FOR CONTROLLING START OF ENGINE-DRIVEN GENERATOR

CROSS-REFERENCE TO RELATED APPLICATION(S)

This application claims priority to and the benefit of Japanese Patent Application No. 2021-202739 filed on Dec. 14, 2021, the entire disclosure of which is incorporated herein by reference.

BACKGROUND OF THE INVENTION

Field of the Invention

The present invention relates to an engine-driven generator, and a method for controlling start of the engine-driven generator.

Description of the Related Art

An engine-driven generator is a generator that can be driven by an engine to generate electric power, and can be carried by a human hand. Therefore, the engine-driven generator is useful for leisure such as camping or at the time of disaster. There is a demand for the advent of a hybrid-type generator capable of supplying the electric power from a battery mounted on such an engine-driven generator, even in a state in which the engine is stopped. For example, it is also possible to charge the battery in the daytime while the sound of the engine is not noticeable and to supply the electric power from the battery in the nighttime. As a method for starting the engine of such a hybrid-type generator, there is a method for driving a cell motor by the battery and starting the engine by the cell motor. Accordingly, the user will no longer use a recoil starter.

Japanese Patent Laid-Open No. 2012-241562 proposes a method for starting the engine by substituting the generator as the cell motor. In such a generator, in a case where the piston of the engine is located at a position before reaching a compression top dead center position, large driving torque is needed to pass over the compression top dead center. For this reason, according to Japanese Patent Laid-Open No. 2012-241562, in a case where the piston of the engine is located at a position before reaching the compression top dead center position, there is a proposal for increasing the drive current that applies an electric current to the winding of the generator in accordance with the distance between the piston and the top dead center position.

According to Japanese Patent Laid-Open No. 2012-241562, in a case where the battery is capable of supplying a sufficient drive current to the winding of the generator, it would be an effective starting method. However, in a case where the charge amount of the battery is insufficient, the piston is not capable of passing over the compression top dead center, and a kickback occurs. The kickback instantaneously generates large torque in a direction opposite to the rotation direction of the crankshaft that is assumed in design. Hence, excessive force is applied to the component parts involved at the start of the engine, and may shorten the life of the engine-driven generator.

SUMMARY OF THE INVENTION

The present disclosure provides an engine-driven generator comprising: an engine; a generator driven by the engine to generate electric power; a motor that starts the engine; a battery that is charged by the generator and that supplies the motor with the electric power at start of the engine; a power supply circuit that is connected to the generator and the battery and that generates and outputs at least one of a direct current voltage and an alternating current voltage; and at least one processor, the at least one processor being configured to: detect that the battery has a sufficient power supply capability that enables a piston of the engine to pass over a compression top dead center, at the start of the engine; and permit ignition of the engine in a case where the at least one processor has detected that the battery has the sufficient power supply capability, and avoid the ignition of the engine in a case where the at least one processor has not detected that the battery has the sufficient power supply capability.

Further features of the present invention will become apparent from the following description of exemplary embodiments (with reference to the attached drawings).

DESCRIPTION OF THE EMBODIMENTS

Figure 1:
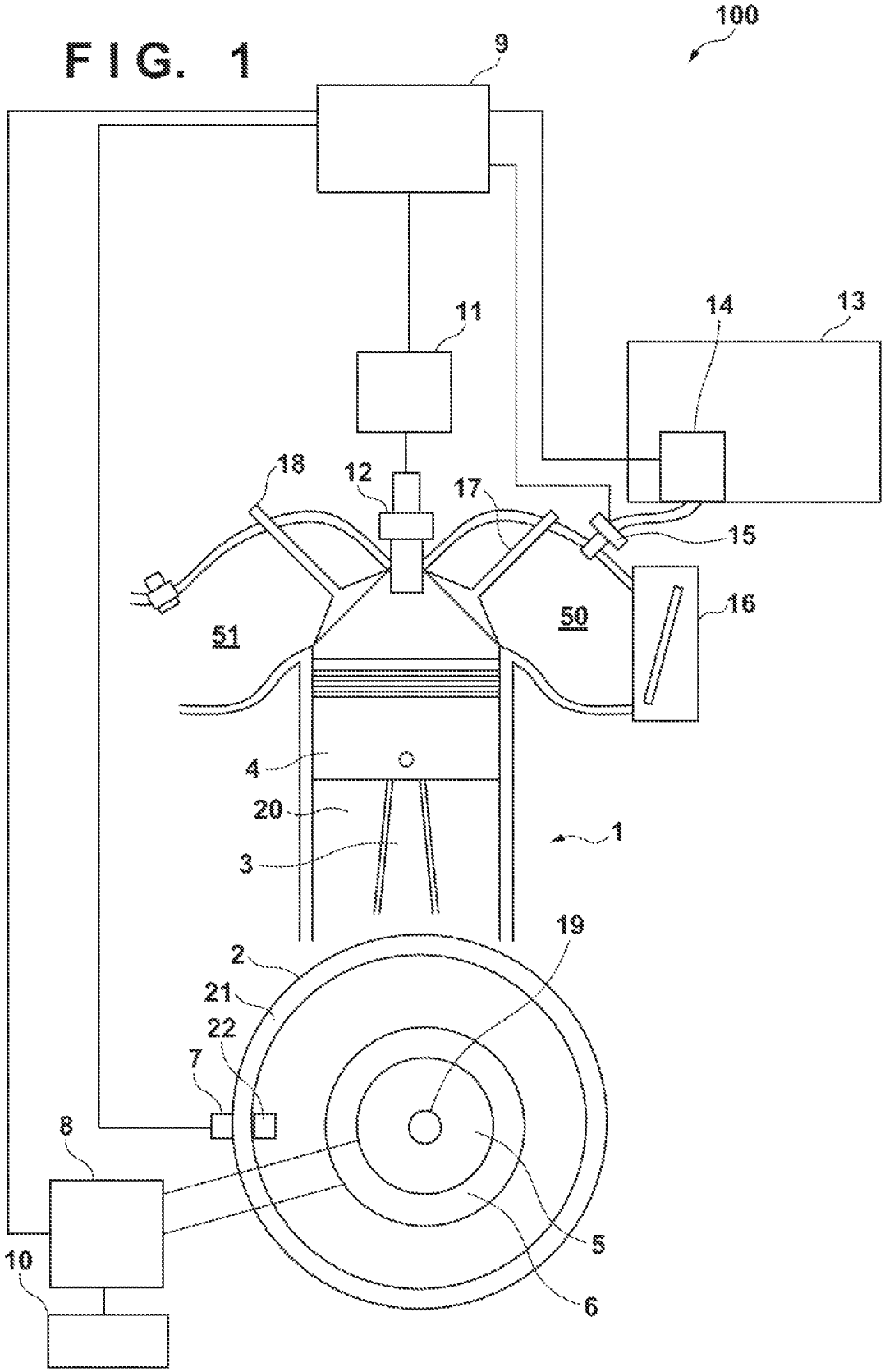
FIG. 1 is a schematic cross-sectional view of an engine-driven generator.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

Engine-Driven Generator

FIG. 1 is a schematic diagram illustrating an engine-driven generator 100. An engine 1 is a four-stroke engine. A crankshaft 19 is accommodated in a crankcase 2. Rotation of the crankshaft 19 causes a piston 4, which is coupled to a connecting rod 3, to move up and down inside a cylinder 20. A starter motor 5 for starting the engine 1 is coupled to the crankshaft 19. The starter motor 5 is an engine starting device that rotates by being supplied with electric power from a battery and that rotates the crankshaft 19 and thus starts the engine 1. A generator 6 is coupled to the crankshaft 19, and rotation of the crankshaft 19 causes the rotor of the generator 6 to rotate and generate the electric power. A pulser coil 7 is a sensor that detects the rotation of a rotor of a flywheel 21 or the generator 6, which is coupled to the crankshaft 19, and that outputs a pulse signal. For example, the pulser coil 7 may be configured to output one pulse whenever the crankshaft 19 makes one rotation. Note that the pulser coil 7 may be a Hall element or the like that detects magnetism of a magnet 22 provided on the rotor of the flywheel 21 or the generator 6.

A power supply circuit 8 includes an inverter that converts an alternating current that has been generated by the generator 6 into an alternating current having a constant frequency, a converter circuit that converts the alternating current into a direct current, a converter circuit that converts the level of a direct current voltage, and the like. The power supply circuit 8 supplies the electric power that has been generated by the generator 6 to a controller 9. The power supply circuit 8 charges a battery 10 with the electric power that has been generated by the generator 6. In addition, the power supply circuit 8 supplies the starter motor 5 with the electric power from the battery 10, and drives the starter motor 5.

The controller 9 is an engine control unit (ECU), and controls the electric power supplied from the power supply circuit 8 to an ignition device 11, a fuel pump 14, an injector 15, a throttle motor 16, and the like. The ignition device 11 supplies an ignition plug 12 with the electric power for ignition to cause spark discharge. A fuel tank 13 is a container for containing fuel. A fuel pump 14 is a pump that supplies the injector 15 with the fuel contained in the fuel tank 13. In FIG. 1, the fuel pump 14 is provided inside the fuel tank. The throttle motor 16 is a motor for controlling an inflow amount of air to flow into the cylinder 20 through an intake passage 50. An intake valve 17 is a valve that is opened and closed by a cam or the like that converts rotational motion of the crankshaft 19 into vertical motion. The intake valve 17 is opened in an intake stroke, but is basically closed in a compression stroke, an expansion stroke, and an exhaust stroke. An exhaust valve 18 is a valve that is opened and closed by a cam or the like that converts the rotational motion of the crankshaft 19 into the vertical motion. The exhaust valve 18 is opened in the exhaust stroke, but is basically closed in the compression stroke, the expansion stroke, and the intake stroke.

Controller and Power Supply Circuit

Figure 2:
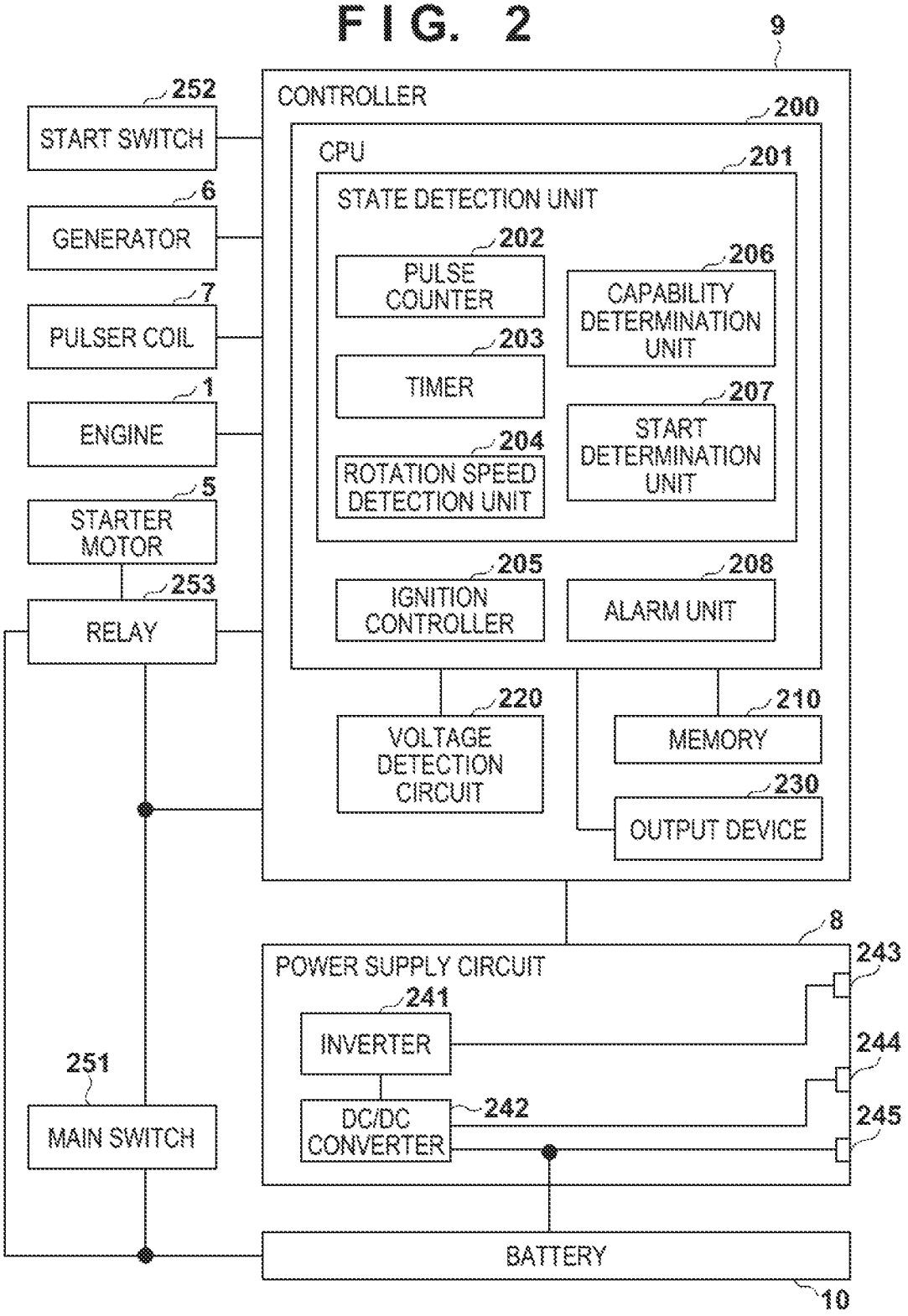
FIG. 2 is a diagram for describing a controller.

FIG. 2 illustrates functions of the controller 9 and functions of the power supply circuit 8. The controller 9 includes a CPU 200, a memory 210, a voltage detection circuit 220, and the like. By executing control programs stored in the memory 210, the CPU 200 implements various functions. The CPU 200 is a central processing unit. The memory 210 includes, for example, a ROM (nonvolatile memory) and a RAM (volatile memory). The voltage detection circuit 220 detects the voltage of the battery 10, and outputs a detection result to the CPU 200. An output device 230 is an acoustic circuit that outputs sound, a light emitting element that outputs light, or a display device that displays an image.

A state detection unit 201 detects various states of the engine-driven generator 100. A pulse counter 202 counts the number of pulses output from a pulser coil 7. A timer 203 measures time. For example, a rotation speed detection unit 204 detects the rotation speed of the engine 1 (crankshaft 19), based on a pulse interval output from the pulser coil 7. A capability determination unit 206 determines that the battery 10 has a sufficient power supply capability to enable the piston 4 of the engine 1 to pass over a compression top dead center (TDC), at the start of the engine 1. Here, the piston 4 passing over the compression top dead center (TDC) means that the piston 4 reaches the compression top dead center in accordance with the rotation of the crankshaft 19, and then the piston 4 descends from the compression top dead center. Note that, since a mixed gas (air+fuel) inside the cylinder 20 is compressed as the piston 4 approaches the compression top dead center, the force for pushing back the piston 4 acts on the piston 4. Therefore, it is necessary for the starter motor 5 to overcome the force for pushing back the piston 4 and to cause the piston 4 to pass over the compression top dead center. When the charge amount of the battery 10 becomes insufficient, a phenomenon that the piston 4 is pushed back occurs (kickback). There are various causes of the kickback. In particular, when the ignition is conducted in spite of a failure of the piston 4 in passing over the compression top dead center, rapid expansion of the combustion gas occurs, and the kickback occurs. Such kickback should be particularly suppressed. This is because since the rotation direction of the crankshaft 19 changes from forward rotation to reverse rotation, a large load is applied to component parts involved at the start of the engine 1, and the lives of the component parts may be shortened. Hence, unless the battery 10 has the sufficient power supply capability to enable the piston 4 of the engine 1 to pass over the compression top dead center (TDC) at the start of the engine 1, it is necessary to interrupt the start of the engine 1 to protect the component parts. A start determination unit 207 determines whether the battery voltage detected by the voltage detection circuit 220 is equal to or higher than a threshold voltage, before the electric power is supplied from the battery 10 to the starter motor 5. Here, the threshold voltage is a battery voltage capable of rotating the starter motor 5. In this case, an alarm unit 208 outputs error information indicating that the battery voltage is too low from the output device 230. An ignition controller 205 supplies the ignition device 11 with the electric power necessary for driving the ignition plug 12 from the battery 10.

A main switch 251 supplies or cuts off the electric power for operation from the battery 10 to a relay 253 and the controller 9. The relay 253 is provided between the battery 10 and the starter motor 5, and turns on/off the supply the electric power from the battery 10 to the starter motor 5, based on an on/off signal of the ignition controller 205. A start switch 252 is a switch for instructing the CPU 200 to start the engine 1. When the start switch 252 is pressed, in a case where the battery voltage is equal to or higher than the threshold voltage, and the battery 10 has the sufficient power supply capability to enable the piston 4 to pass over the compression top dead center, the CPU 200 switches the relay 253 from off to on.

In the power supply circuit 8, an inverter 241 is a conversion circuit that converts an alternating current that has been generated by the generator 6 into an alternating current of a predetermined frequency. A DC/DC converter 242 is a circuit that converts and outputs the level of the direct current voltage that has been generated in the inverter 241. For example, the DC/DC converter 242 converts a direct current voltage of 12 V into a direct current voltage of 5 V or 3.3 V. An AC outlet 243 outputs the alternating current that has been generated by the inverter 241. A DC outlet 244 outputs the direct current voltage of 5 V that has been generated by the DC/DC converter 242. A DC outlet 245 outputs the direct current voltage of 12 V that has been generated by the DC/DC converter 242. Note that the DC/DC converter 242 includes a built-in charging circuit, and charges the battery 10.

Detection (Determination) of Electric Power Supply Capability

Figure 3:
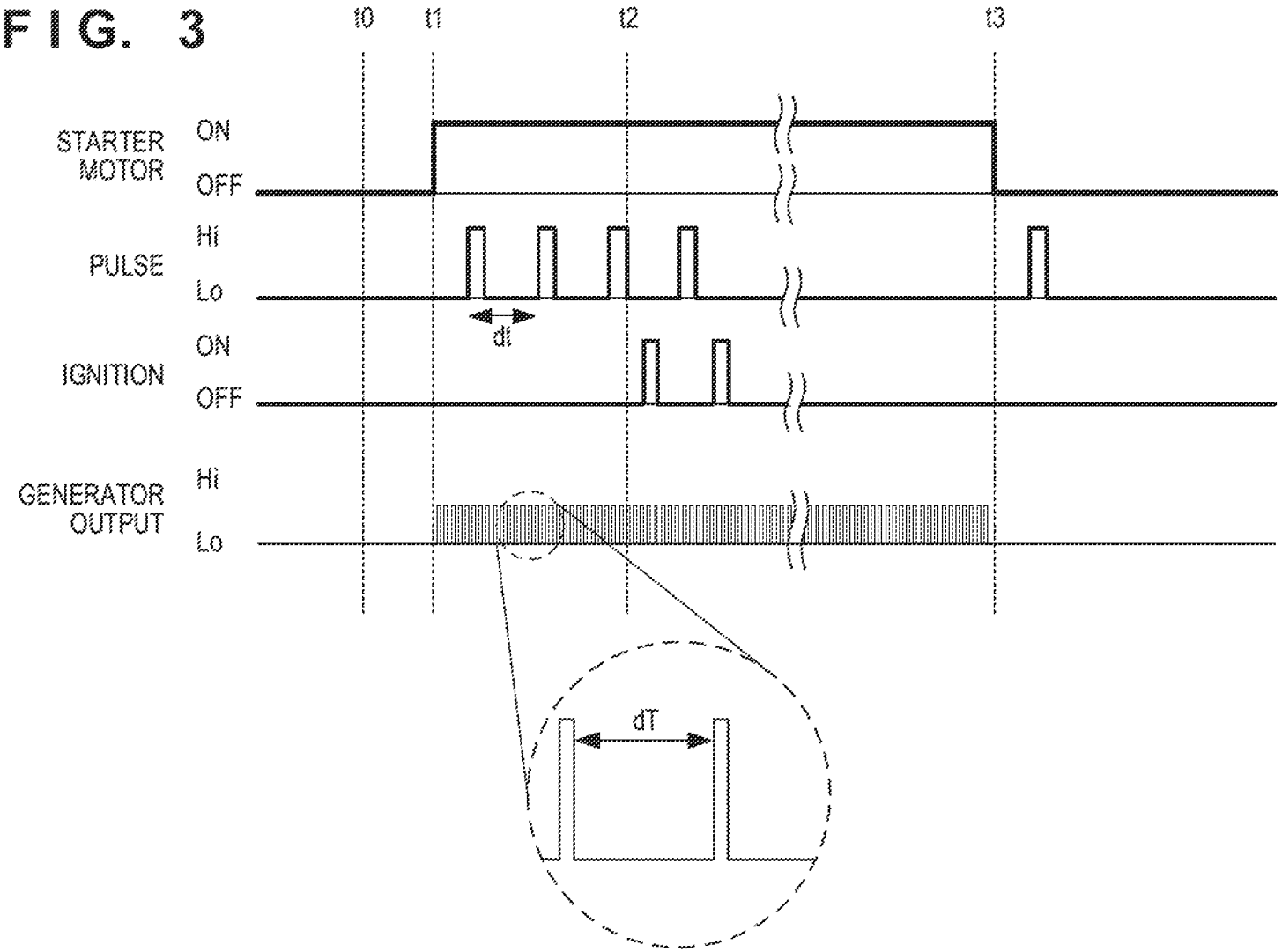
FIG. 3 is a diagram for describing a method for detecting that a piston has passed over a compression top dead center.

FIG. 3 is a diagram for describing a method for detecting the electric power supply capability of the battery 10. The horizontal axis represents time.

When the main switch 251 is switched from off to on at time t0, the electric power is supplied from the battery 10 and the controller 9 starts operating.

The start switch 252 is pressed at time t1. Accordingly, the start determination unit 207 determines whether the battery voltage is equal to or higher than the threshold voltage. Here, it is assumed that the battery voltage is equal to or higher than the threshold voltage. Therefore, the CPU 200 switches the relay 253 from off to on, and starts supplying the electric power from the battery 10 to the starter motor 5. Accordingly, the starter motor 5 starts rotating, and the starter motor 5 rotates the crankshaft 19. Note that when the crankshaft 19 rotates, the generator 6 also starts the power generation. In addition, the pulser coil 7 outputs one pulse whenever the crankshaft 19 makes one rotation.

A four-stroke engine, by the way, conducts intake, compression, combustion, and exhaust, while the crankshaft 19 is making two rotations. That is, the piston 4 reaches the highest point (top dead center) twice, while the crankshaft 19 is making two rotations. Here, it is uncertain which one of the four processes of intake, compression, combustion, and exhaust the piston 4 is located at a position corresponding to. For example, the piston 4 would reach the compression top dead center before the crankshaft 19 makes one rotation, the piston 4 would reach the compression top dead center before the crankshaft 19 makes two rotations, or the piston 4 would reach the compression top dead center before the crankshaft 19 makes three rotations. Therefore, it can be an issue how many pulses are counted to be able to determine with certainty that the piston 4 has passed over the compression top dead center. That is, it can be an issue what threshold to be compared with the number of pulses should be.

For example, in a case where the threshold is 1, as soon as the first pulse is detected, the ignition is started. However, even though the first pulse is detected, the piston 4 does not pass over the compression top dead center, in some cases. Similarly, in a case where the threshold is 2, as soon as the second pulse is detected, the ignition is started. However, even though the second pulse is detected, the piston 4 does not pass over the compression top dead center, in some cases. Therefore, when at least the third pulse is detected, the crankshaft 19 has made at least two rotations. Thus, the piston 4 certainly passes over the compression top dead center. For this reason, the threshold is set to a value equal to or larger than 3.

As described above, it is sufficient if the threshold is equal to or larger than 3. However, by intentionally setting the threshold to 3, the engine 1 can be started at the shortest time.

In FIG. 3, dt represents an interval between pulses output from the pulser coil 7. As the rotation speed of the crankshaft 19 increases, the pulse interval dt decreases. Therefore, the rotation speed detection unit 204 is capable of calculating the rotation speed of the crankshaft 19 from the pulse interval dt.

Similarly, the rotation speed detection unit 204 is capable of calculating the rotation speed of the crankshaft 19 from the pulse interval dT. The pulse interval dT indicates an interval between output voltage pulses generated by the generator 6. As the rotation speed of the crankshaft 19 increases, the pulse interval dT decreases. For this reason, the rotation speed detection unit 204 is capable of calculating the rotation speed of the crankshaft 19 from the pulse interval dT.

Flowchart

Figure 4:
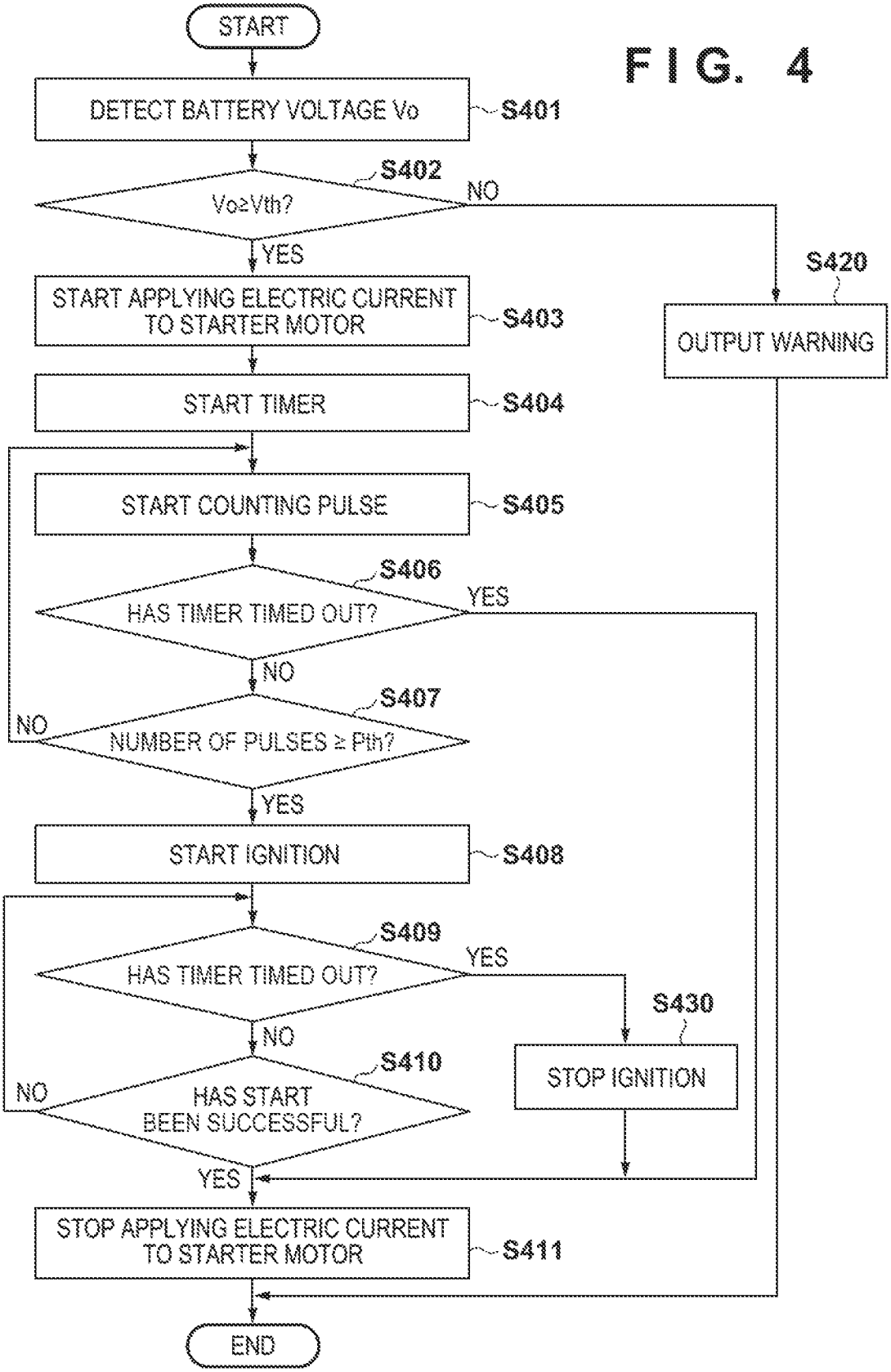
FIG. 4 is a flowchart illustrating a control method.

FIG. 4 is a flowchart illustrating a method for starting the engine. When the start switch 252 is pressed, the CPU 200 performs the following process.

In step S401, the CPU 200 detects a battery voltage Vo by using the voltage detection circuit 220.

In step S402, the CPU 200 determines whether the battery voltage Vo is equal to or higher than a threshold voltage Vth. In a case where the battery voltage Vo is not equal to or higher than the threshold voltage Vth, the CPU 200 proceeds to step S420. In step S420, the CPU 200 outputs, from the output device 230, a warning indicating that the battery voltage is too low. Accordingly, the electric current is not applied to the starter motor 5, and the engine starting process ends. On the other hand, in a case where the battery voltage Vo is equal to or higher than the threshold voltage Vth, the CPU 200 proceeds to step S403.

In step S403, the CPU 200 starts applying the electric current to the starter motor 5. For example, the CPU 200 switches the relay 253 from off to on, and the electric power is supplied from the battery 10 to the starter motor 5. Accordingly, the starter motor 5 starts rotating.

In step S404, the CPU 200 starts the timer 203. A predetermined start period is set in the timer 203. The start period is a period from time t1 to time t3 in FIG. 3.

In step S405, by resetting the count value of the pulse counter 202 to 0, the CPU 200 starts counting the pulse.

In step S406, the CPU 200 determines whether the timer 203 has timed out. In a case where the start of the engine 1 is not successful until the timer 203 times out, the CPU 200 proceeds to step S411. In step S411, the CPU 200 switches the relay 253 from off to on, and applying the electric current to the starter motor 5 is stopped. In a case where the timer 203 has not timed out, the CPU 200 proceeds to step S407.

In step S407, the CPU 200 determines whether the number of pulses Pn that have been counted by the pulse counter 202 is equal to or larger than a pulse threshold Pth. That is to say, in step S407, it is determined whether the battery 10 has a sufficient power supply capability to enable the piston 4 to pass over the compression top dead center. For this purpose, the pulse threshold Pth is set to a value equal to or larger than 3. In a case where the number of pulses Pn is not equal to or larger than the pulse threshold Pth, the CPU 200 returns to step S405. That is, in a case where the number of pulses Pn smaller than the pulse threshold Pth, the CPU 200 returns to step S405. On the other hand, in a case where the number of pulses Pn is equal to or larger than the pulse threshold Pth, the CPU 200 proceeds to step S408. That is to say, in a case where the battery 10 has the sufficient power supply capability, the CPU 200 proceeds to step S408.

In step S408, the CPU 200 starts ignition. The CPU 200 instructs the ignition device 11 for ignition. Accordingly, the ignition device 11 supplies the ignition plug 12 with the electric power in synchronization with a predetermined ignition timing.

In step S409, the CPU 200 determines whether the timer 203 has timed out. In a case where the start of the engine 1 is not successful until the timer 203 times out, the CPU 200 proceeds to step S430. In step S430, the CPU 200 stops the ignition. For example, the CPU 200 instructs the ignition device 11 to stop the ignition. Then, the CPU 200 proceeds to step S411, and stops the starter motor 5. On the other hand, in a case where the timer 203 has not timed out in step S409, the CPU 200 proceeds to step S410.

In step S410, the CPU 200 determines whether the start of the engine 1 has been successful. For example, in a case where the rotation speed of the crankshaft 19 is equal to or higher than a threshold, the CPU 200 determines that the start of the engine 1 has been successful. On the other hand, in a case where the rotation speed of the crankshaft 19 is smaller than the threshold, the CPU 200 determines that the start of the engine 1 has not been successful. In a case where the start of the engine 1 has not been successful, the CPU 200 returns to step S409. On the other hand, in a case where the start of the engine 1 has been successful, the CPU 200 proceeds to step S411. In step S411, the CPU 200 switches the relay 253 from on to off, and stops the starter motor 5.

Technical Ideas Derived from Embodiments

First Aspect

An engine-driven generator 100 includes, for example, an engine 1;

a generator 6 driven by the engine 1 to generate electric power;

a motor (for example, the starter motor 5) that starts the engine 1;

a battery 10 that is charged by the generator 6 and that supplies the motor with the electric power at start of the engine 1;

a power supply circuit 8 that is connected to the generator 6 and/or the battery 10 and that generates and outputs at least one of a direct current voltage and an alternating current voltage;

a detection section (for example, the CPU 200, the capability determination unit 206) configured to detect that the battery 10 has a sufficient power supply capability that enables a piston 4 of the engine 1 to pass over a compression top dead center, at the start of the engine 1; and a control section (for example, the CPU 200, the ignition controller 205) configured to permit ignition of the engine 1 in a case where it is detected that the battery 10 has the sufficient power supply capability is detected by the detection section, and avoid the ignition of the engine 1 in a case where it is detected that the battery 10 has the sufficient power supply capability is not detected by the detection section. This configuration enables protection of component parts involved at the start of the engine-driven generator 100, in a state in which a kickback is likely to occur (for example, a state in which the battery 10 does not have the sufficient power supply capability).

Second Aspect

The engine-driven generator 100 according to the first aspect may further include a sensor (e.g., pulser coil 7) configured to output a pulse signal in accordance with rotation of the crankshaft 19 of the engine 1. As illustrated in FIG. 3, the detection section may detect that the battery 10 has the sufficient power supply capability, based on the number of pulses output from the sensor. As illustrated in FIG. 3, in a case where no pulse is detected, it would be apparent that the charge amount of the battery 10 is insufficient. In addition, in a case where one or two pulses are detected, there is a possibility that the piston 4 does not pass over the compression top dead center. On the other hand, in a case where three or more pulses are detected, it is certain that the piston 4 has passed over the compression top dead center. Therefore, by focusing on the number of pulses, it would be apparent that the battery 10 has the sufficient power supply capability. Herein, a case example, in which one pulse is output when the crankshaft 19 makes one rotation, is introduced. However, this is merely an example. Two or more pulses may be output while the crankshaft 19 is making one rotation. For example, in a case where a sensor that outputs N or more pulses while the crankshaft 19 is making one rotation is adopted (N is a natural number of 1 or more) and 3N pulses are output, it is certain that the piston 4 has passed over the compression top dead center. Therefore, the threshold Pth is set to 3N.

Third Aspect

The engine 1 may be, for example, a four-stroke engine. The sensor may be configured to output one pulse whenever the crankshaft 19 of the engine 1 makes one rotation. After the electric power is supplied from the battery 10 to the motor, in a case where three or more pulses are output by the sensor, the detection section may determine that the battery 10 has the sufficient power supply capability.

Fourth Aspect

After the detection section has detected that the battery 10 has the sufficient power supply capability and, thus, the control section permits the ignition of the engine, the start of the engine 1 fails in some cases. In this case, the control section may stop an ignition operation of the engine 1. Even though the battery 10 has the sufficient power supply capability, the start of the engine 1 may fail due to another factor such as fuel shortage. Therefore, the ignition operation of the engine 1 may be stopped so as not to wastefully consume the electric power of the battery 10.

Fifth Aspect

A rotation speed of the engine 1 may not become equal to or higher than a threshold until a predetermined period elapses (for example, a period from time t1 to time t3) after the electric power is supplied from the battery 10 to the motor and the motor starts rotating. In other words, a rotation speed of the engine 1 may be still lower than a threshold when a predetermined period elapses (for example, a period from time t1 to time t3) after the electric power is supplied from the battery 10 to the motor and the motor starts rotating. In this case, the control section may determine that the start of the engine 1 has failed. Once the engine 1 is started, the rotation speed of the engine 1 is controlled to an appropriate rotation speed. On the other hand, unless the engine 1 is started, the rotation speed of the engine 1 cannot be increased to an appropriate rotation speed. Therefore, it is possible to determine with certainty that the start of the engine 1 has failed, based on the rotation speed of the engine 1.

Sixth Aspect

The voltage detection circuit 220 is an example of a voltage detection section configured to detect the voltage of the battery 10. In a case where the voltage of the battery 10 detected by the voltage detection section is equal to or higher than a rotatable voltage that enables the motor to rotate, the control section supplies the electric power from the battery 10 to the motor. On the other hand, in a case where the voltage of the battery 10 detected by the voltage detection section is not equal to or higher than the rotatable voltage, the controller does not supply the electric power from the battery 10 to the motor. In other words, in a case where the voltage of the battery 10 detected by the voltage detection section is lower than the rotatable voltage, the controller does not supply the electric power from the battery 10 to the motor. As described above, in a state in which the voltage of the battery 10 is too low, the engine 1 is not started. Thus, it would be possible to prevent the over discharge of the battery 10. However, in a case where the engine 1 includes a kick starter or a recoil starter, the start of the engine 1 should be permitted.

Seventh Aspect

The CPU 200 (alarm unit 208) and the output device 230 are examples of a warning section configured to output at least one of warning sound and warning information in a case where the voltage of the battery 10 detected by the voltage detection section is not equal to or higher than the rotatable voltage. In other words, the warning section may be configured to output at least one of warning sound and warning information in a case where the voltage of the battery 10 detected by the voltage detection section is lower than the rotatable voltage. Accordingly, the user immediately understands an error of the battery 10 and may replace the battery 10 or charge the battery 10 from an external power supply.

The invention is not limited to the foregoing embodiments, and various variations/changes are possible within the spirit of the invention.

What is claimed is:

1. An engine-driven generator comprising:

a four-stroke engine;

a sensor configured to output one pulse per one rotation of a crankshaft of the engine;

a generator driven by the engine to generate electric power;

a motor that starts the engine to rotate a regular direction;

a battery that is charged by the generator and that supplies the motor with the electric power at start of the engine;

a power supply circuit that is connected to the generator and the battery and that generates and outputs at least one of a direct current voltage and an alternating current voltage;

a switch connected between the power supply circuit and an ignition plug of the engine; and at least one processor, the at least one processor being configured to:

count a number of pulses output from the sensor after the electric power is supplied from the battery to the motor;

detect that a kickback condition in which the engine rotates an irregular direction opposite to the regular direction is met, by determining, based on the number of pulses, whether the battery has a sufficient power supply capability that enables a piston of the engine to pass over a compression top dead center, at the start of the engine; and permit turning the switch on for ignition of the engine in a case where the at least one processor has detected that the kickback condition is not met, and maintain turning the switch off to avoid the ignition of the engine in a case where the at least one processor has detected that the kickback condition is met, wherein the at least one processor determines that the battery has the sufficient power supply capability in a case where the number of pulses is equal to or more than three pulses which are output from the sensor.

2. The engine-driven generator according to claim 1, wherein when the start of the engine fails after the at least one processor has detected that the battery has the sufficient power supply capability and, thus, the at least one processor permits the ignition of the engine, the at least one processor stops an ignition operation of the engine.

3. The engine-driven generator according to claim 2, wherein in a case where a rotation speed of the engine is still lower than a threshold when a predetermined period elapses after the electric power is supplied from the battery to the motor and the motor starts rotating, the at least one processor determines that the start of the engine has failed.

4. The engine-driven generator according to claim 1, further comprising a voltage detection circuit configured to detect a voltage of the battery, wherein in a case where the voltage of the battery detected by the voltage detection circuit is equal to or higher than a rotatable voltage that enables the motor to rotate, the at least one processor supplies the electric power from the battery to the motor, and, in a case where the voltage of the battery detected by the voltage detection circuit is lower than the rotatable voltage, the at least one processor does not supply the electric power from the battery to the motor.

5. The engine-driven generator according to claim 4, further comprising a warning device including a least one of:

an acoustic circuit configured to output warning sound in a case where the voltage of the battery detected by the voltage detection circuit is lower than the rotatable voltage;

a light emitting element configured to output warning light in a case where the voltage of the battery detected by the voltage detection circuit is lower than the rotatable voltage; or a display device configured to display warning information in a case where the voltage of the battery detected by the voltage detection circuit is lower than the rotatable voltage.

6. A method for controlling an engine-driven generator, the method comprising:

supplying electric power from a battery to a motor;

starting a four-stroke engine to rotate a regular direction by the motor;

outputting from a sensor one pulse per one rotation of a crankshaft of the engine;

counting a number of pulses output from the sensor after the electric power is supplied from the battery to the motor;

detecting that a kickback condition in which the engine rotates an irregular direction opposite to the regular direction is met, by determining, based on the number of pulses, whether the battery has a sufficient power supply capability that enables a piston of the engine to pass over a compression top dead center, at the start of the engine;

upon the kickback condition being not met, permitting turning a switch on for ignition of the engine, driving a generator by the engine and thus causing the generator to generate electric power, supplying the electric power output from the generator to the battery to charge the battery, and generating and outputting, by a power supply circuit connected to the generator and the battery, at least one of a direct current voltage and an alternating current voltage; and upon the kickback condition being met, maintaining turning the switch off to avoid the ignition of the engine in a case where it is not determined that the battery has the sufficient power supply capability, wherein it is determined that the battery has the sufficient power supply capability in a case where the number of pulses is equal to or more than three pulses which are output from the sensor.

* * * * *